US005666882A

United States Patent [19]

Theurer et al.

[11] Patent Number: 5,666,882

[45] Date of Patent: Sep. 16, 1997

[54] TRANSPORT WAGON FOR TRANSPORTING TRACK PANELS

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 564,310

[22] PCT Filed: May 9, 1995

[86] PCT No.: PCT/AT95/00091

§ 371 Date: Nov. 30, 1995

§ 102(e) Date: Nov. 30, 1995

[87] PCT Pub. No.: WO95/30797

PCT Pub. Date: Nov. 16, 1995

[30] Foreign Application Priority Data

May 10, 1994 [AT] Austria ..... 978/94

[51] Int. Cl.[6] ..... E01B 29/02

[52] U.S. Cl. ..... 104/3

[58] Field of Search ..... 104/2, 3; 105/4.1; 213/75 R

[56] References Cited

U.S. PATENT DOCUMENTS

| | | | |
|---|---|---|---|
| 4,627,359 | 12/1986 | Buhler | 104/3 |
| 4,773,332 | 9/1988 | Theurer et al. | 104/3 |
| 4,784,063 | 11/1988 | Theurer et al. | 104/3 |
| 5,108,955 | 4/1992 | Hawryszkow et al. | 105/4.1 |
| 5,127,335 | 7/1992 | Whitaker, Jr. . | |
| 5,231,929 | 8/1993 | Theurer et al. | 104/2 |

FOREIGN PATENT DOCUMENTS

| | | |
|---|---|---|
| 388 000 | 4/1989 | Austria . |
| 0 276 646 | 8/1988 | European Pat. Off. . |
| 34 19 205 | 12/1984 | Germany . |
| 661 546 | 7/1987 | Switzerland . |

OTHER PUBLICATIONS

ETR Eisenbahntechnische Rundschau, vol. 38, No. 3, Mar. 89 Darmstadt, pp. 145–149: MISAR: "Zweiwegefahrbare Weichenumbasumaschine".

*Primary Examiner*—S. Joseph Morano
*Attorney, Agent, or Firm*—Collard & Roe, P.C.

[57] ABSTRACT

A transport wagon (50) for transporting track panels (53) has a wagon frame (56) which may be supported on on-track undercarriages (54) or alternatively on off-track undercarriages (55) and which has a loading surface (57) for laying down the track panel (53). The wagon frame (56) is composed of a main frame part (62) having two on-track undercarriages (54) and two off-track undercarriages (55) and two auxiliary frames (60,61) connected to the main frame part (62) by means of a universal joint (63). The said auxiliary frame has at its end remote from the joint (63) an on-track undercarriage (54) and a vertically adjustable off-track undercarriage (55).

10 Claims, 1 Drawing Sheet

TRANSPORT WAGON FOR TRANSPORTING TRACK PANELS

Figure 1:
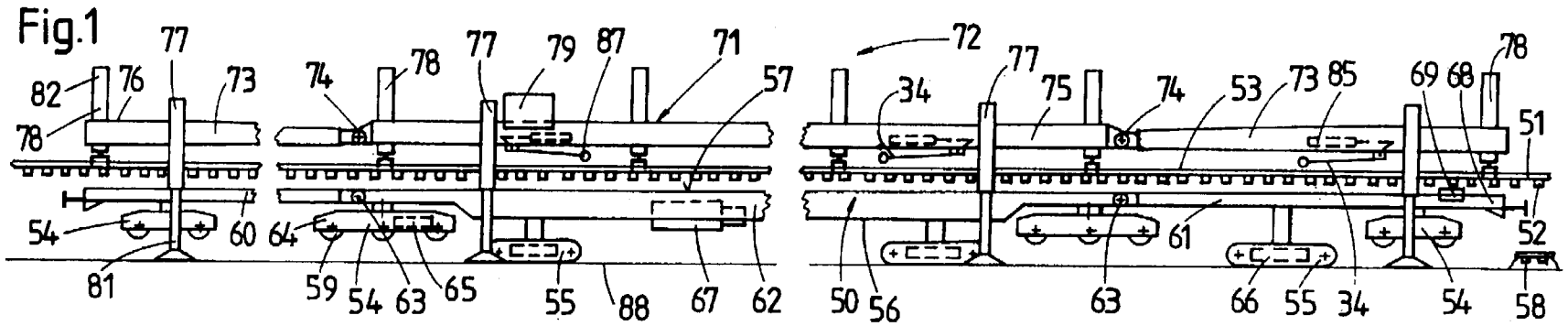

The invention relates to a transport wagon for transporting track panels, comprising a wagon frame which may be supported on on-track undercarriages or alternatively on off-track undercarriages, and which has a loading surface for laying down the track panel.

A transport wagon of this kind is already known from EP 0 276 646 B1 and is used together with an independent lifting device. During the removal of a track panel or a switch, the lifting device—comprising a carrier frame extending in the longitudinal direction of the track—is positioned over the track panel with the aid of the transport wagon, whereupon the carrier frame is supported on the ballast bed by means of two pairs of laterally and vertically adjustable lifting jacks and is simultaneously lifted off the transport wagon. The transport wagon is then removed and the lifting device is lowered onto the track panel by means of the lifting jacks. After the rails have been gripped by vertically adjustable carrier means comprising gripping elements, the carrier frame together with the track panel is raised again with the aid of the lifting jacks. The transport wagon is now moved into the track gap underneath the lifted track panel by means of lowered caterpillar-tracked undercarriages and removes the track panel together with the carrier frame. When a new track panel or a switch is installed, the same procedure takes place in reverse order. With very long track panels, two arrangements of this kind are used, one arranged following the other at a distance therefrom.

Another arrangement of this kind is known from AT 388 000 B which is composed of a lifting device and a transport wagon independently mobile of the said lifting device. The lifting device in this case has two on-track undercarriages—each associated with a pair of lifting jacks—and with the aid of these on-track undercarriages is designed to travel on the track or on the track panel to be removed or installed. The lifting device and the track panel may be loaded together on the transport wagon by means of the lifting jacks.

Another track maintenance machine disclosed in DE 34 19 205 C2 for laying and removing track panels essentially consists of an elongated carrier frame composed of two frame sections arranged one following the other in the longitudinal direction of the track and joined together by means of a universal joint. The beam-shaped frame is provided at either end and also at the articulation point with a vertically adjustable on-track undercarriage and a caterpillar-tracked undercarriage and is thereby able to travel both on the track and on the ballast bed of a track construction site, the track panel being gripped by vertically adjustable gripping devices and being lifted or lowered.

The object of the present invention is now to provide a transport wagon of the type previously defined which is suitable specifically for transporting very long track panels, more particularly switch sections in association with their installation in or removal from the track.

This object is achieved according to the invention with a transport wagon specified in the introduction in that the wagon frame is composed of a main frame part comprising two on-track undercarriages and two off-track undercarriages and at least one auxiliary frame connected to the main frame part by means of a universal joint, the said auxiliary frame having at its end remote from the joint an on-track undercarriage and a vertically adjustable off-track undercarriage.

With this advantageous combination of features, even very long track panels which have already been preassembled at the factory for quality optimization reasons may for the first time be transported without difficulty, and this transport may be implemented without conversion work from the loading site to the trackless renewal gap or in the opposite direction. With the arrangement both of an on-track and an off-track undercarriage in the articulation region, the said articulation region may be automatically centred over the track axis both in the renewal gap and in the track region. On the other hand, however, it is also optionally possible to vary the transverse distance of the articulation point of the carrier frame or of the loading wagon from the track axis. This results, on the one hand, in the two frame parts of the carrier frame being capable of being optimally aligned with a line through the center of gravity of the switch to be lifted, for example, while, on the other hand, the two frame parts of the transport wagon can be adjusted to an optimum position with respect to the transport path.

Further advantageous and partially inventive developments of the invention emerge from the sub-claims.

Figure 2:
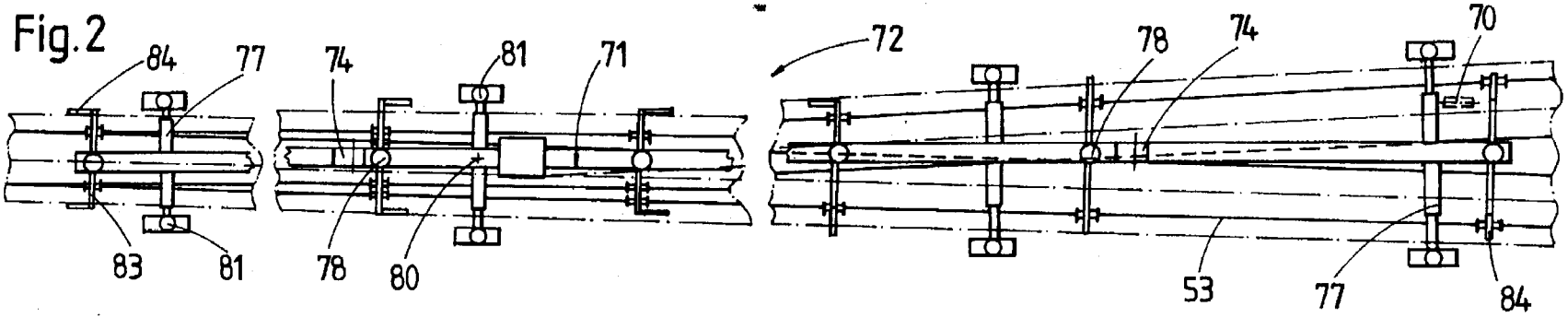
Figure 3:
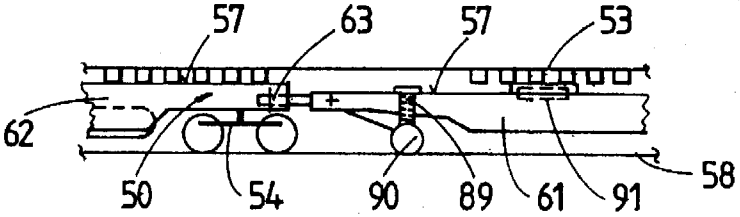

The invention is described in more detail in the following with the aid of an exemplary embodiment shown in the drawing, in which FIG. 1 shows a simplified side view of a transport wagon loaded with a track panel, a lifting device being provided to lift the track panel from the transport wagon, FIG. 2 shows a schematized plan view of the track panel transported by the transport wagon, and FIG. 3 shows a simplified partial side view of another embodiment of a transport wagon.

A transport wagon 50 for transporting a track panel 53 comprising rails 51 and sleepers 52 consists of a wagon frame 56, supported on on-track undercarriages 54 and off-track undercarriages 55, with a loading surface 57 provided for supporting the track panel 53. This loading surface extends in the horizontal plane when wheel contact points 59 created by the contact of the on-track undercarriages 54 with a track 58 are in a horizontal plane.

The wagon frame 56 extending in the longitudinal direction of the track is composed of two auxiliary frames 60,61, between which is located a main frame part 62. Each auxiliary frame 60,61 is connected to the main frame part 62 by means of a universal joint 63. The on-track undercarriage 54 fixed to the main frame part 62 immediately adjacent to the joint 63 is designed as a three-axle bogie undercarriage 64 with a motive drive 65. Immediately adjoining the bogie undercarriage 64, a total of two off-track undercarriages 55 in the form of caterpillar-tracked undercarriages with motive drives 66 are connected to the main frame part 62. The aforementioned motive drives 65,66 and also various other vertical adjustment drives are provided with energy by means of an engine 67. The joints 63 are each designed as releasable couplings, so that if required one or both auxiliary frames 60,61 can be detached from the main frame part 62.

Each auxiliary frame 60,61 has in an end region 68 remote from the joint 63 an on-track undercarriage 54 and, between that and the bogie undercarriage 64, a vertically adjustable off-track undercarriage 55. Also provided in this end region is a plurality of support rollers 69, arranged side by side in the transverse direction of the wagon, for supporting the track panel 53. Each support roller 69 has an axis of rotation 70 extending in the longitudinal direction of the wagon and parallel to the loading surface 57.

A lifting device 71 forms together with the transport wagon 50 an arrangement 72 for taking up, laying and also for transporting a track panel 53. The lifting device 71 has two auxiliary lifting frame parts 73 arranged at its ends, each connected to a main lifting frame part 75 by means of a joint 74. Associated with each auxiliary lifting frame part 73 in an end region 76 remote from the joint 74 are a lifting jack pair 77 and also a carrier means 78. The main lifting frame part 75 has two lifting jack pairs 77 spaced apart in the longitudinal direction of the frame and arranged in the region of the joint 74. Altogether four carrier means 78, spaced apart from one another in the longitudinal direction of the frame, are connected to the main lifting frame part 75. The various drives of the lifting device 71 are provided with energy by means of an engine 79 connected to the main lifting frame part 75.

Each lifting jack pair 77 is connected to the main lifting frame part 75 or to the auxiliary lifting frame part 73 so as to be rotatable about a vertical axis 80. The lifting jacks 81 arranged on the two longitudinal sides of the frame are designed so as to be telescopically extendable independently of one another both in the horizontal direction and in the vertical direction by means of appropriate drives.

Each carrier means 78 consists of a vertically adjustable vertical support 82 and a horizontal lifting beam 83. The outer end sections 84 (FIG. 2) of each lifting beam 83, with respect to the transverse direction of the track, are designed so as to be pivotable horizontally and may be pivoted inwards into a position extending in the longitudinal direction of the track.

Associated with each auxiliary lifting frame part 73 and the main lifting frame part 75 are auxiliary undercarriages 34, pivotable in the longitudinal direction of the frame by means of drives 85 and comprising a flanged wheel pair 87. The joints 74 are designed as releasable couplings.

In the schematized representation shown in FIG. 2 the outlines of the transport wagon 50 have been omitted for the sake of better visibility. The position of the lifting device 71 in relation to the loading surface 57 of the transport wagon 50 may advantageously be varied in dependence on the dimensions of the track panel 53 to be transported.

In the position shown in FIG. 1, the arrangement 72 is located in a renewal gap 88 intended for the depositing of the track panel 53. The transport wagon 50 is supported by means of the lowered off-track undercarriages 55 on a ballast formation of the renewal gap 88. The track panel 53 which is in form-locking connection with the carrier means 78 is lifted from the loading surface 57 by lowering the lifting jacks. After the transport wagon 50 has been moved out of the renewal gap 88 onto the adjoining track 58, through operation of the motive drives 66, the track panel 53 is lowered by retracting the lifting jacks of the lifting jack pairs 77. When the track panel 53 has been deposited on the ballast formation, the transport wagon 50 is moved onto the track panel 53 by means of its on-track undercarriages 54, whereupon the lifting device 71, raised in the meantime, is lowered onto the loading surface 57. The arrangement 72 is then moved away from the construction site by operation of the motive drives 65.

In a design variant of a transport wagon 50 shown schematically in FIG. 3, the loading surface 57 of the auxiliary frame 61 (or 60) is positioned lower down than the adjoining loading surface 57 of the main frame part 62. In addition, an auxiliary undercarriage 90, vertically adjustable by means of a drive 89, is associated with the auxiliary frame 60 in the region of the joint 63. A sliding plate 91 for supporting the track panel 53, extending parallel to the loading surface 57 and mounted so as to be displaceable in the transverse direction of the wagon, is associated with the auxiliary frame 61 at its end remote from the joint 63.

We claim:

1. A transport wagon for transporting track panels, which comprises (a) a wagon frame extending in a longitudinal direction and having a loading surface for supporting the track panel, the wagon frame being comprised of
  (1) a main frame part having two opposite ends for supporting a substantial portion of said panels and
  (2) at least one auxiliary frame part for supporting a remaining end portion of said panels, (b) a universal joint connecting one end of the auxiliary frame part to one of the main frame part ends whereby the auxiliary frame part is guided by the main frame part, (c) an on-track undercarriage and an off-track undercarriage selectively supporting the main frame part adjacent each main frame part end, and (d) an on-track undercarriage and an off-track undercarriage selectively supporting an end of the auxiliary frame part remote from the universal joint.

2. The transport wagon of claim 1, wherein the on-track undercarriage supporting the main frame part is arranged between the universal joint and the off-track undercarriage supporting the main frame part.

3. The transport wagon of claim 1, wherein the universal joint is a releasable coupling.

4. The transport wagon of claim 1, further comprising an auxiliary undercarriage selectively supporting the auxiliary frame part between the remote end of the auxiliary frame part and the universal joint.

5. The transport wagon of claim 4, wherein the auxiliary undercarriage is a vertically adjustable single-axle bogie, further comprising a drive for vertically adjusting the bogie.

6. The transport wagon of claim 1, wherein the loading surface of the auxiliary frame part is lower than that of the main frame part.

7. The transport wagon of claim 1, wherein the on-track undercarriage supporting the main frame part is a three-axle swivel truck.

8. The transport wagon of claim 1, further comprising a plurality of support rollers arranged at the remote end of the auxiliary frame part side-by-side in a direction extending transversely to the longitudinal direction and having axes of rotation extending in the longitudinal direction and parallel to the loading surface.

9. The transport wagon of claim 1, further comprising a sliding plate arranged at the remote end of the auxiliary frame part, the sliding plate extending parallel to the loading surface and being displaceable thereon in a direction extending transversely to the longitudinal direction.

10. A transport wagon for transporting track panels, which comprises (a) a wagon frame extending in a longitudinal direction and having a loading surface for supporting the track panel, the wagon frame being comprised of
  (1) a main frame part having two opposite ends for supporting a substantial portion of said panels and
  (2) two auxiliary frame parts for supporting remaining end portions of said panels, (b) a respective universal joint connecting one end of each auxiliary frame part to a respective one of the opposite main frame part ends whereby the auxiliary frame parts are guided by the main frame part, (c) an on-track undercarriage and an off-track undercarriage selectively supporting the main frame part adjacent each universal joint, and (d) an on-track undercarriage and an off-track undercarriage selectively supporting an end of the auxiliary frame parts remote from the universal joint.

* * * * *